US009533792B2

(12) United States Patent
Park

(10) Patent No.: US 9,533,792 B2
(45) Date of Patent: Jan. 3, 2017

(54) MULTIPURPOSE BOX

(71) Applicant: CJ CHEILJEDANG CORPORATION, Seoul (KR)

(72) Inventor: Eun-Jin Park, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 0 days.

(21) Appl. No.: 13/874,370

(22) Filed: Apr. 30, 2013

(65) Prior Publication Data

US 2013/0320075 A1 Dec. 5, 2013

(30) Foreign Application Priority Data

May 30, 2012 (KR) ..... 20-2012-0004531 U

(51) Int. Cl.
*B65D 25/00* (2006.01)
*B65D 5/52* (2006.01)

(52) U.S. Cl.
CPC ..... *B65D 5/526* (2013.01); *B65D 5/522* (2013.01)

(58) Field of Classification Search
CPC ..... B65D 55/02; B65D 17/163; B65D 5/526; B65D 5/522
USPC ..... 206/751, 45.2, 767, 214, 45.21, 45.22,206/764, 765, 514
See application file for complete search history.

(56) References Cited

U.S. PATENT DOCUMENTS 414,450 A * 11/1889 Schwartz ..... 206/45.28
476,765 A * 6/1892 Knapp ..... 206/45.28
495,949 A * 4/1893 Fear ..... 206/45.28
636,950 A * 11/1899 Butcher ..... 206/45.28
1,033,550 A * 7/1912 Crankshaw ..... 206/45.28
1,190,700 A * 7/1916 Appleton ..... 206/45.28
1,236,509 A * 8/1917 Waldeck ..... 206/45.28
1,239,094 A * 9/1917 Fischer ..... 206/45.28
1,291,540 A * 1/1919 Joslin ..... 206/45.28
1,421,384 A * 7/1922 Beatty ..... B65D 5/5206 206/45.21
1,450,334 A * 4/1923 Schwenneke ..... 206/45.28
1,453,849 A * 5/1923 List ..... B65D 5/5206 206/45.22

(Continued)

FOREIGN PATENT DOCUMENTS

JP 58-109979 U 7/1983
JP 59-115720 U 8/1984

(Continued)

OTHER PUBLICATIONS

Nakamura, Jinya; Blister Package; JP10-053275A Machine Translation.*

(Continued)

*Primary Examiner* — Nathan J Newhouse
*Assistant Examiner* — Jennifer N Zettl
(74) *Attorney, Agent, or Firm* — Lewis Roca Rothgerber Christie LLP

(57) ABSTRACT

A multipurpose box includes a receiving case having a space therein, an auxiliary plate extended upwardly from the receiving case, and a pair of cut portions spaced apart from each other on the auxiliary plate. The multipurpose box is capable of packaging a product and concurrently having a business card, a photograph, or the like, placed therein. The multipurpose box can be reused as a frame, or to store simple things such as office supplies and/or the like at a later time.

6 Claims, 5 Drawing Sheets

(56) References Cited

U.S. PATENT DOCUMENTS 1,471,478 A * 10/1923 Feigelman ..... B65D 5/5206 206/45.22
1,483,125 A * 2/1924 Singer ..... B65D 5/5206 206/45.22
1,502,248 A * 7/1924 Hawley ..... 206/732
1,508,337 A * 9/1924 Milton ..... 206/45.28
1,524,881 A * 2/1925 Rippenbein ..... 206/45.29
1,549,331 A * 8/1925 Rippenbein ..... B65D 5/5206 206/45.21
1,556,054 A * 10/1925 Warshaw ..... B65D 5/5206 206/45.22
1,578,698 A * 3/1926 Zareko ..... 206/45.29
1,590,683 A * 6/1926 Helfrich ..... B65D 5/5206 206/45.21
1,616,708 A * 2/1927 Tanner ..... 206/45.29
1,622,284 A * 3/1927 List ..... B65D 5/5206 206/45.21
1,625,171 A * 4/1927 Tanner ..... 206/45.3
1,626,324 A * 4/1927 Booth ..... 206/45.29
1,665,620 A * 4/1928 Amatel ..... 206/732
1,674,953 A * 6/1928 Darragh ..... B65D 5/5206 206/45.22
1,679,923 A * 8/1928 Tanner ..... 206/45.3
1,714,542 A * 5/1929 Bergstein ..... 206/45.29
1,730,437 A * 10/1929 Sanderson ..... 206/735
1,732,436 A * 10/1929 Floto ..... B65D 5/5206 206/45.21
1,733,803 A * 10/1929 Sanderson ..... 206/45.3
1,775,338 A * 9/1930 Darragh ..... B65D 5/5206 206/45.21
1,822,007 A * 9/1931 Cable ..... 206/732
1,839,752 A * 1/1932 Fogg ..... 206/45.29
1,907,630 A * 5/1933 Ward ..... 206/730
1,911,678 A * 5/1933 Dunn, Jr. ..... 206/730
1,919,880 A * 7/1933 Einson ..... 206/750
1,934,312 A * 11/1933 Lambert ..... B65D 5/5206 206/45.21
1,949,376 A * 2/1934 Mansfield et al. ..... 206/765
2,019,995 A * 11/1935 Rippen ..... 206/45.3
2,083,345 A * 6/1937 Eaton ..... 229/102.5
2,115,269 A * 4/1938 Lane ..... 206/742
2,124,335 A * 7/1938 Klein ..... 206/45.29
2,168,240 A * 8/1939 Roberts ..... 206/45.29
2,179,109 A * 11/1939 Wheeler ..... B65D 71/16 206/45.21
2,248,547 A * 7/1941 Osteen ..... B65D 5/5206 206/45.21
2,271,258 A * 1/1942 Henderson ..... 206/766
2,276,890 A * 3/1942 Steinbiss ..... 229/108
2,294,965 A * 9/1942 Davidson ..... B65D 5/5425 206/45.21
2,298,136 A * 10/1942 Lavere ..... B65D 5/5226 206/45.29
2,309,753 A * 2/1943 Cowles et al. ..... 206/760
2,336,731 A * 12/1943 Henderson ..... 206/45.29
2,339,112 A * 1/1944 Roberts et al. ..... 206/734
2,351,378 A * 6/1944 Weissman ..... A47F 7/03 206/45.29
2,375,843 A * 5/1945 Gottlieb ..... B65D 5/5021 206/45.29
2,385,268 A * 9/1945 Gillam ..... B65D 5/5206 206/45.22
2,502,561 A * 4/1950 Ebert ..... 206/750
2,517,030 A * 8/1950 Ringler ..... B65D 5/5206 206/45.21
2,598,149 A * 5/1952 Turner ..... B65D 5/5206 206/45.22
2,663,412 A * 12/1953 Cerino ..... B65D 83/10 206/45.21
2,669,350 A * 2/1954 Railton ..... B65D 85/546 206/45.21
2,801,739 A * 8/1957 Christensen ..... B65D 5/5253 206/45.21
3,009,565 A * 11/1961 Leone ..... 206/752
3,127,010 A * 3/1964 Capezzuto ..... B65D 75/368 206/214
3,146,937 A * 9/1964 Vesak ..... 229/117.22
3,164,350 A * 1/1965 Taub ..... A47F 5/114 206/764
3,167,179 A * 1/1965 Goldstein ..... 206/763
3,327,688 A * 6/1967 Smith ..... B43M 99/008 206/214
3,340,998 A * 9/1967 Wilson ..... A47F 7/146 206/734
3,352,478 A * 11/1967 Wood ..... 229/125.08
3,392,903 A * 7/1968 Morgan, Jr. ..... B65D 27/00 206/45.21
3,567,014 A * 3/1971 Feigelman ..... 206/767
4,049,114 A * 9/1977 Danheisser ..... B65D 5/5206 206/45.25
4,201,292 A * 5/1980 Davidson et al. ..... 206/45.29
4,311,233 A * 1/1982 Austin ..... B65D 5/5206 206/45.21
4,463,848 A * 8/1984 Parker ..... B42F 17/02 206/214
4,917,240 A * 4/1990 Roberts et al. ..... 206/232
5,881,884 A * 3/1999 Podosek ..... 206/774
6,394,290 B1 * 5/2002 Walsh ..... A47F 5/114 108/115
D481,533 S * 11/2003 McGillivray et al. ..... D3/206
6,837,378 B2 * 1/2005 Mason et al. ..... 206/745
7,413,075 B2 * 8/2008 David ..... B65D 77/044 206/277
8,191,713 B2 * 6/2012 Calendrille, Jr. ..... A63H 3/50 206/736
8,439,187 B2 * 5/2013 Tumminia et al. ..... 206/45.29
8,596,460 B2 * 12/2013 Scatterday ..... 206/736
2001/0052480 A1 * 12/2001 Kawaguchi et al. ..... 206/736
2002/0043554 A1 * 4/2002 White et al. ..... 229/235
2010/0276333 A1 * 11/2010 Couture ..... 206/774
2011/0049226 A1 * 3/2011 Moreau et al. ..... 229/112

FOREIGN PATENT DOCUMENTS

JP 59-133435 U 9/1984
JP 1-107520 U 7/1989
JP 10053275 A * 2/1998
JP 10-203047 8/1998
JP 3082186 9/2001
JP 2002-336102 11/2002
JP 2010-030635 2/2010

OTHER PUBLICATIONS

Korean Office Action dated Jul. 11, 2013 of the corresponding Korean Application No. 20-20120004531, noting listed references in this IDS (3 pages).
English Machine Translation of Japanese Patent No. 3082186.
International Search Report and Written Opinion of corresponding International Patent application PCT/KR2013/003032, dated Jun. 4, 2013, (9 pages).

* cited by examiner

MULTIPURPOSE BOX

CROSS-REFERENCE TO RELATED APPLICATION

This application claims priority to and the benefit of Korean Utility Application No. 20-2012-0004531 , filed on May 30, 2012, in the Korean Intellectual Property Office, the entire content of which is incorporated herein by reference.

BACKGROUND

1. Field

The present invention relates to a multipurpose box having other uses in addition to packaging a product.

2. Description of the Related Art

Generally, in order to introduce a product, various promotional materials such as pens, key rings, umbrellas, calendars, cups, and/or the like, are being produced and used. In order to more directly introduce a product, a box containing small samples is also being used.

However, because the box containing samples described above is discarded after a customer takes the samples out of it, the box does not continue to have promotional effect and primarily act as a container storing the product.

Therefore, for the promotion of their products, manufacturers typically advertise the products in addition to distributing boxes containing samples and/or the like. As a consequence, the manufacturers typically pay huge advertising costs.

A business card made of paper or an opaque or transparent synthetic resin is an object most commonly used to introduce oneself to others. A salesperson makes his or her business activities for the promotion of the product by directly transferring the business card or placing the business card in a product catalog when meeting a customer.

However, because a time and a place to store the business card are varied according to a customer's tendency and necessity and information on what product to sell cannot be immediately confirmed, a more effective or efficient business card transferring method may be desirable.

The above information disclosed in this Background section is only for enhancement of understanding of the background of the invention and therefore it may contain information that does not form the prior art that is already known in this country to a person of ordinary skill in the art.

SUMMARY

An aspect of embodiments according to the present invention is to provide a multipurpose box capable of packaging a product and concurrently having a business card, a photograph, or the like, placed therein, making it possible to cause the customer to consistently memorize a company or a product.

Another aspect of embodiments according to the present invention is to provide a multipurpose box capable of being reused so as to store and transfer products as well as to receive and organize office supplies such as a pen, or the like.

Still another aspect of embodiments according to the present invention is to provide a multipurpose box capable of being easily gripped and transferred by a user.

In order to achieve the aspects described above, according to one embodiment of the present invention, there is provided a multipurpose box including a receiving case having a space therein, and an auxiliary plate extended upwardly from the receiving case. The auxiliary plate has thereon a pair of cut portions spaced apart from each other.

The multipurpose box may further include a grip opening on the auxiliary plate. The grip opening may allow the multipurpose box to be easily gripped by a user.

The multipurpose box may further include an outer case including an upper part configured for opening and closing so as to receive the receiving case therein.

The auxiliary plate may be exposed to the outside through an opening on the upper part.

The receiving case and the auxiliary plate may be integrally formed with each other.

The multipurpose box may be made of a paper material.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
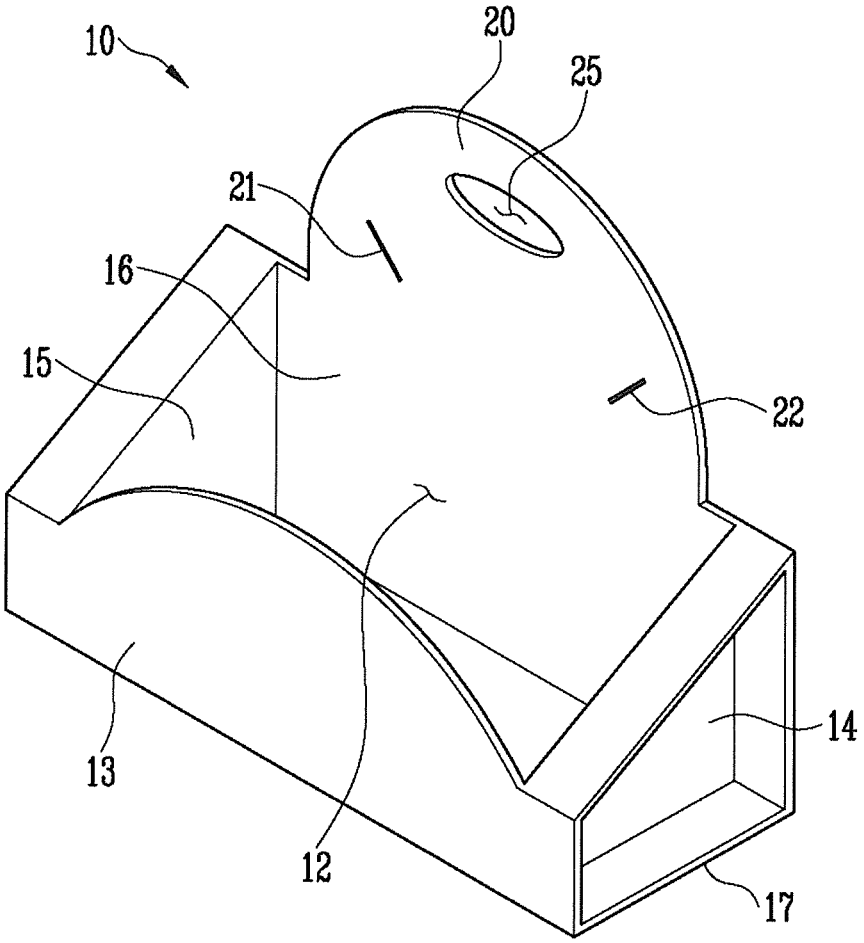
FIG. 1 is a view showing a receiving case according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements.

Specific matters of other exemplary embodiments will be included in a detailed description and the accompanying drawings.

Aspects and features of the present invention and methods to achieve them will be elucidated from exemplary embodiments described below in detail with reference to the accompanying drawings. However, the present invention is not limited to exemplary embodiments described below, and may be implemented in various forms. These exemplary embodiments may be provided so that this disclosure will be thorough and complete, and will fully convey the scope of the invention to those skilled in the art. The scope of the present invention is defined by the accompanying claims and their equivalents if appropriate. Like reference numerals throughout the description denote like elements.

Hereafter, a multipurpose box according to exemplary embodiments of the present invention will be described with reference to the exemplary embodiments and accompanying drawings for illustrating the exemplary embodiments.

FIG. 1 is a view showing a receiving case according to an exemplary embodiment of the present invention.

Referring to FIG. 1, the multipurpose box according to the exemplary embodiment of the present invention is configured to include a receiving case 10, auxiliary plate 20, and a pair of cut portions 21 and 22.

The receiving case 10 has a receiving space (e.g., a predetermined receiving space) 12, thereby making it possible to receive a product to be transferred to a customer in the receiving space 12.

In addition, the customer can use the receiving space 12 formed in the receiving case 10 later to organize and store things such as office supplies, and/or the like.

As an example, the receiving case 10 may include a bottom part 17 on which the product, or the like is seated, a front part 13 coupled to the one end of the bottom part 17 and forming a front surface of the receiving case 10, a rear part 16 connected to the other end of the bottom part 17 and forming a rear surface of the receiving case 10, and lateral parts 14 and 15 forming both lateral surfaces of the receiving case 10.

However, the shape of the receiving case 10 is not limited to that of FIG. 1, and may be variously changed.

As an example, the lateral parts 14 and 15 do not close the entire surface of each lateral surface of the receiving case 10, but may close only a portion of each of the lateral surfaces. As another example, the front part 13 may be removed or may have a height different from that of the rear part 16.

In one embodiment, the receiving case 10 described above is made of a paper material which is light weight and easily produced, but made of a material such as plastic, or the like, as well.

The auxiliary plate 20 may be extended upwardly from the receiving case 10 and may have a plate shape.

For example, as shown in FIG. 1, the auxiliary plate 20 may be extended upwardly from an upper end of the rear surface 16 of the receiving case 10.

In one embodiment, the auxiliary plate 20 is formed integrally with the receiving case 10 for convenience, but may be formed separately and then attached to the receiving case 10.

In addition, the auxiliary plate 20 may be made of a paper material which is light and easily produced, but made of a material such as plastic, or the like, as well.

The auxiliary plate 20 is formed with a pair of cut portions (e.g., slits) 21 and 22 spaced apart from each other. As can be seen in FIG. 1, the cut portions 21 and 22 are arranged or oriented at an angle with respect to each other.

The spacing distance between the cut portions 21 and 22 may be varied according to the size of the thing inserted and fixed at both cut portions 21 and 22 (for example, a business card, a photograph, a promotional material, or the like).

At this time, an object such as the business card, the photograph, or the like has both end portions inserted at both cut portions 21 and 22, respectively, thereby making it possible to fix the object on the auxiliary plate 20.

In addition, the auxiliary plate 20 may additionally have a grip hole 25 (or grip opening) formed thereon (or there through) in order to be easily gripped by a user.

In the case in which the grip hole 25 is not present on the auxiliary plate 20, it is difficult for the user to grip or grab the receiving case 10; but in the case in which the grip hole 25 is present on the auxiliary plate 20 the user easily grips the receiving case 10 by putting his or her fingers into the grip hole 25.

Figure 2:
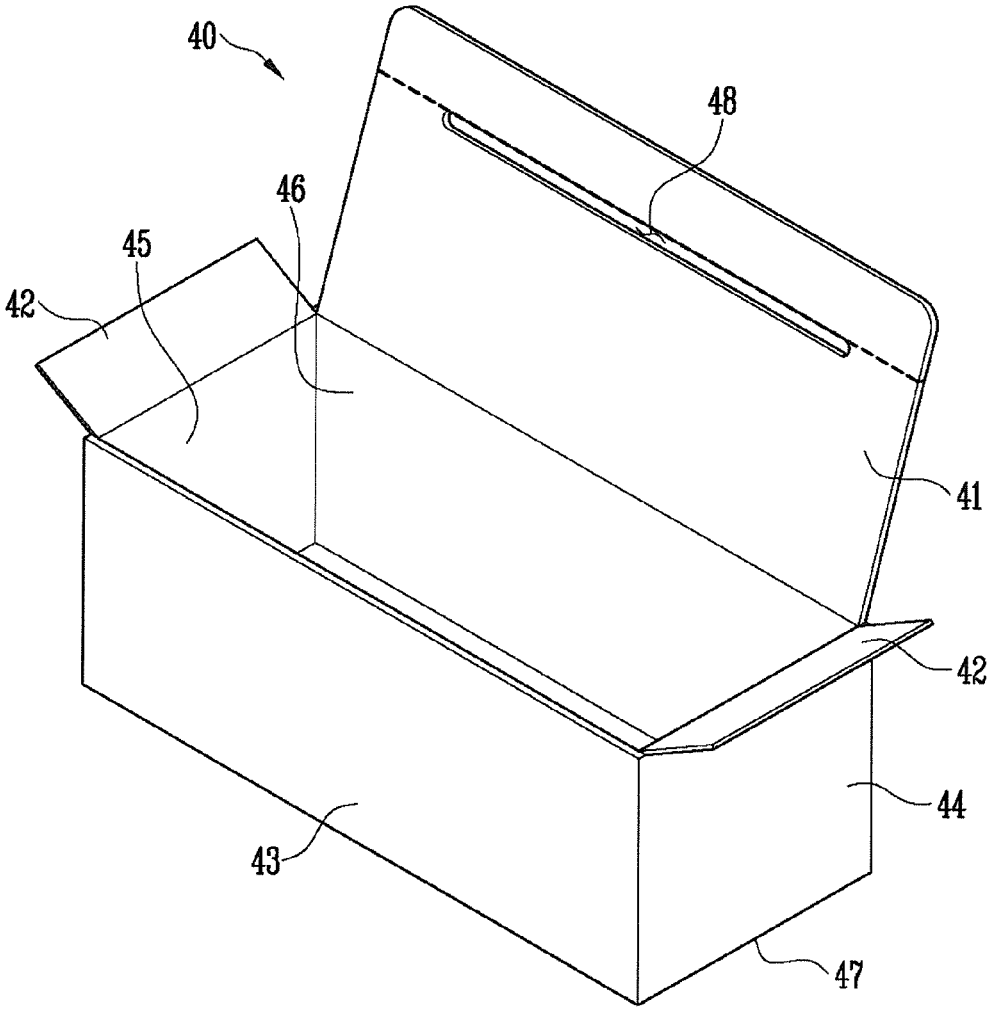
FIG. 2 is a view showing an outer case according to an exemplary embodiment of the present invention.

FIG. 2 is a view showing an outer case according to an exemplary embodiment of the present invention.

Referring to FIG. 2, the multipurpose box may further include an outer case 40.

Here, the outer case 40 has an upper part 41 capable of (or configured for) opening and closing, thereby making it possible to receive the receiving case 10 therein.

In the case in which the receiving case 10 is received in the outer case 40, a through hole (or slit) 48 may be formed on the upper part 41 of the outer case 40 so that the auxiliary plate 20 coupled to the receiving case 10 may be exposed or protruded to the outside.

Here, the width and length of the through hole (e.g., opening or slit) 48 may be set properly so that the auxiliary plate 20 may pass through to the outside.

As an example, the outer case 40 may include a bottom part 47 on which the receiving case 10 is seated, a front part 43 coupled to the one end of the bottom part 47 and forming a front surface of the outer case 40, a rear part 46 coupled to the other end of the bottom part 47 and forming a rear surface of the outer case 40, and lateral parts 44 and 45 forming both lateral surfaces of the outer case 40.

In addition, the outer case 40 may further include wing portions (or flaps) 42 each coupled to respective ends of the lateral portions 44 and 45.

Referring to FIG. 2, an upper part 41 of the outer case 40 may be coupled to the end of the rear part 46, by way of example, in the state of being able to be folded and opened.

In addition, the outer case 40 may be designed in various different shapes capable of receiving the receiving case 10 therein.

In one embodiment, the outer case 40 is made of a paper material which is light and easily produced, but may also be made of a material such as plastic, or the like.

Figure 3:
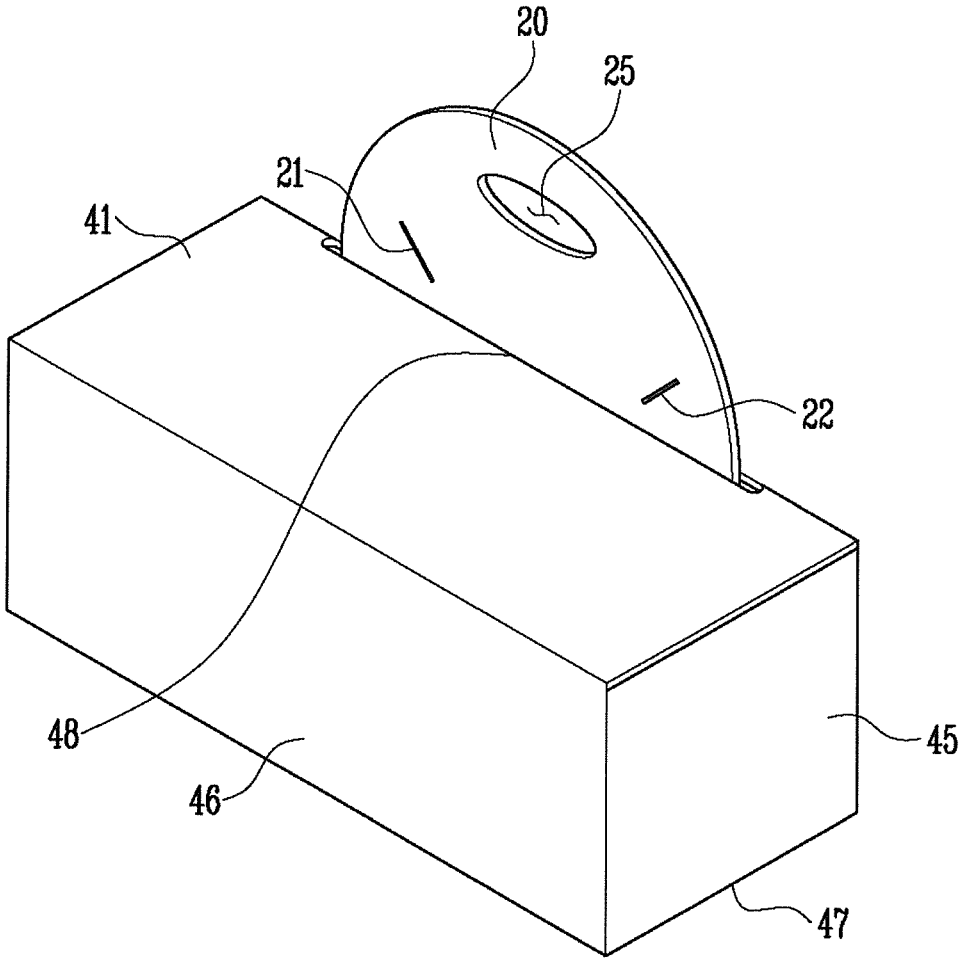
FIG. 3 is a view showing a state in which a multipurpose box according to an exemplary embodiment of the present invention is coupled (or assembled)

FIG. 3 is a view showing a state in which a multipurpose box according to an exemplary embodiment of the present invention is coupled.

Sellers may receive a product or a sample of the product in the receiving space of the receiving case 10 and package the receiving case 10 using the outer case 40.

In addition, in the state in which the upper part 41 is open, the receiving case 10 is placed in the outer case 40, and then the upper part 41 may be closed so that the auxiliary plate 20 may pass through the opening (e.g., through hole or slit) 48 formed at the upper part 41.

Therefore, as shown in FIG. 3, the auxiliary plate 20 may be exposed to the outside through the opening (e.g., through hole or slit) 48 formed at the upper part 41 of the outer case 40. As can be seen in FIG. 2, the upper part in the described embodiment has a folded/folded part at a distal end from the rear part 46, such that the folded/foldable part can be inserted into the opening of the outer case 40 when the outer case 40 is closed. The opening 48 is formed or located adjacent the folded/foldable part.

Figure 4:
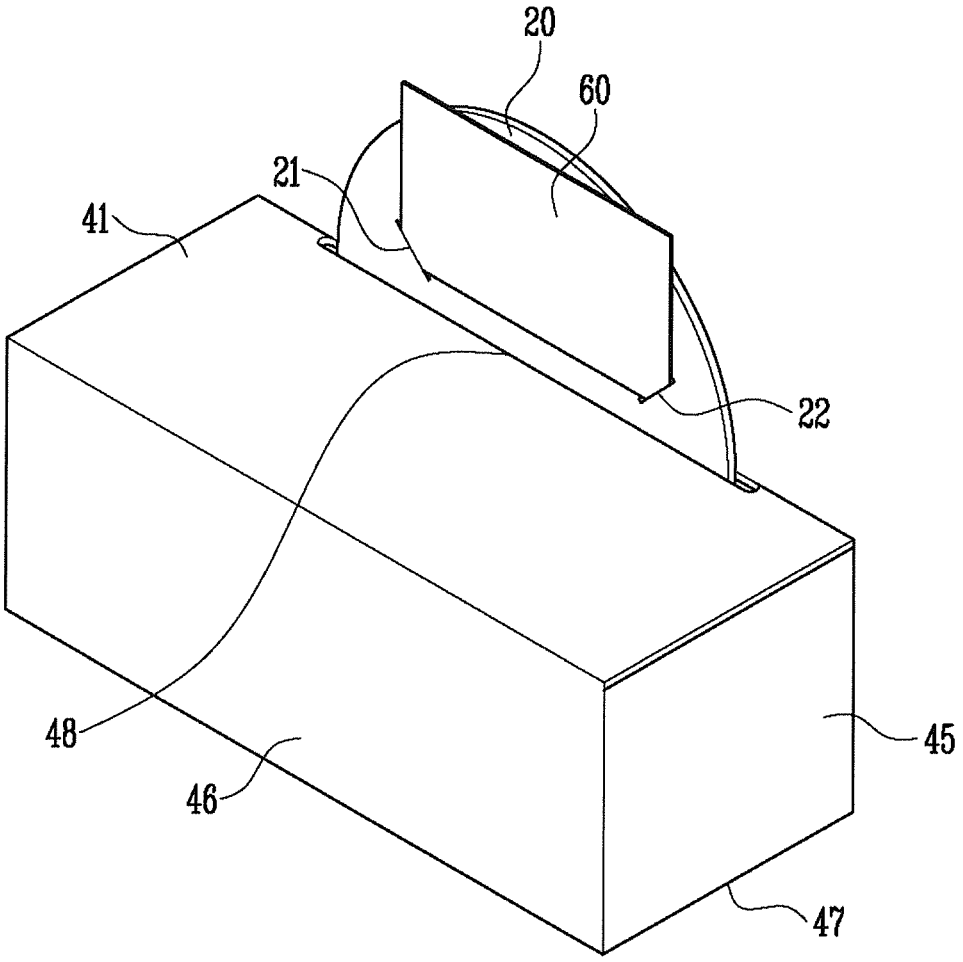
FIG. 4 is a view showing an example of the multipurpose box shown in FIG. 3.

FIG. 4 is a view showing an example of the multipurpose box shown in FIG. 3.

As shown in FIG. 4, a salesperson, who promotes a product, may transfer the multipurpose box to his or her customers in the state in which his or her business card 60 is inserted in the cut portions 21 and 22.

Also, instead of or in addition to the business card 60, the salesperson may insert a photograph, a product manual, other promotional material, and/or the like in the cut portions 21 and 22 to transfer it to his or her customers.

Therefore, the multipurpose box according to the exemplary embodiments of the present invention may receive a business card, and/or the like, on the outside as well as package and transfer products, thereby making it possible to increase promotion effect.

Figure 5:
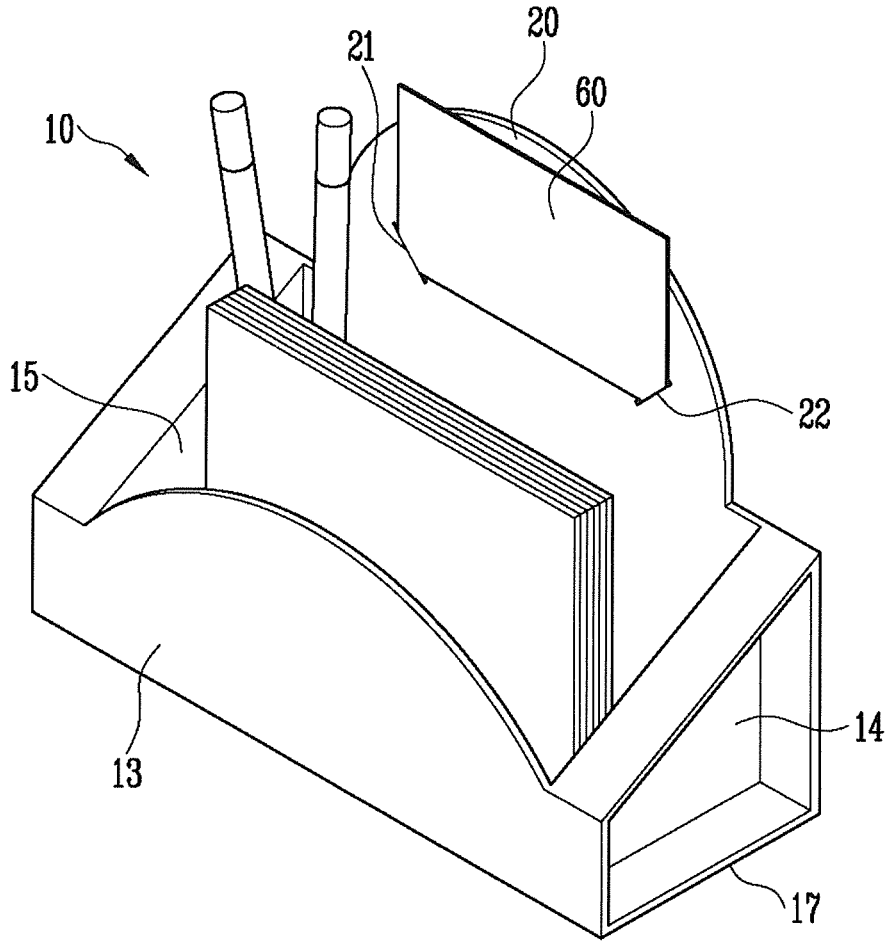
FIG. 5 is a view showing an example of the receiving case shown in FIG. 1.

FIG. 5 is a view showing an example of the receiving case shown in FIG. 1.

When a customer receives the multipurpose box from the salesperson, or the like, he or she may open the upper part 41 of the outer case 40 to take the receiving case 10 out of the outer case 40.

At this time, the customer may continue to use the business card 60 attached to the auxiliary plate 20 without removing it, or use the receiving case 10 as a frame by inserting another thing, such as a photograph, and/or the like, into the cut portions 21 and 22, instead of the business card.

In addition, the customer may receive other office supplies, such as a pen, a note, or the like, in the receiving space 12 of the receiving case 10, as shown in FIG. 5.

The multipurpose box according to the exemplary embodiments of the present invention may be reused after products received in the multipurpose box are taken out. Therefore the customer (client) consistently may memorize (or be reminded of) the product, the salesperson, or the manufacturer, thereby making it possible to significantly increase promotion effect.

As set forth above, according to exemplary embodiments of the present invention, a multipurpose box capable of packaging a product and concurrently having a business card, a photograph, and/or the like, placed therein makes it possible to cause the customer to consistently memorize (or be reminded of) a company, a salesperson, or a product.

In addition, according to exemplary embodiments of the present invention, a multipurpose box capable of being reused to store and transfer products as well as to receive and organize office supplies such as a pen, and/or the like is provided.

In addition, according to exemplary embodiments of the present invention, a multipurpose box capable of being easily gripped and transferred by a user is provided.

Those skilled in the art will appreciate that various modifications, additions and substitutions are possible, without departing from the scope and spirit or essential features of the present invention. Therefore, the exemplary embodiments described above should be understood as only examples in every respect and not limited thereto. While the present invention has been described in connection with certain exemplary embodiments, it is to be understood that the device is not limited to the disclosed embodiments, but, on the contrary, is intended to cover various modifications and equivalent arrangements included within the spirit and scope of the appended claims, and equivalents thereof.

What is claimed is:

1. A multipurpose box comprising:

a receiving case having a space therein;

an auxiliary plate extended upwardly from the receiving case, the auxiliary plate having therein a pair of slits spaced apart from each other; and an outer case including an upper part configured for opening and closing so as to receive the receiving case therein, wherein the upper part has a through slit therein, wherein the auxiliary plate is exposed to the outside through the slit of the upper part of the outer case, wherein the pair of slits are tilted and formed cutting the auxiliary plate, and positioned outside of the outer case, wherein upper ends of the pair of slits are farther from the receiving case than lower ends of the pair of slits, and wherein the respective upper ends of the pair of slits are spaced farther apart from each other than the respective ends of the pair of slits are.

2. The multipurpose box according to claim 1, further comprising: a grip opening on the auxiliary plate.

3. The multipurpose box according to claim 1, wherein the receiving case and the auxiliary plate are integrally formed with each other.

4. The multipurpose box according to claim 1, wherein the multipurpose box comprises a paper material.

5. The multipurpose box according to claim 1, wherein the receiving case comprises:

a bottom part;

a front part connected to one end of the bottom part;

a rear part connected to another end of the bottom part; and lateral parts connected between the front part and the rear part, respectively, and forming both lateral surfaces of the receiving case.

6. The multipurpose box according to claim 5, wherein the auxiliary plate extended upwardly from an upper part of the rear part.

* * * * *